US005234374A

United States Patent [19]

Hyzyk et al.

[11] Patent Number: 5,234,374

[45] Date of Patent: Aug. 10, 1993

[54] AIR DUCT CLOSURE SYSTEM

[76] Inventors: Mariusz Hyzyk, RR 2, Peterburg, Ontario, Canada, N0B 2H0; Tadeusz Rekret, 86 Freeland Drive, Stratford, Ontario, Canada, N4Z 1H1

[21] Appl. No.: 813,086

[22] Filed: Dec. 24, 1991

[51] Int. Cl.[5] ..... F24F 13/08

[52] U.S. Cl. ..... 454/322; 454/258

[58] Field of Search ..... 138/93; 251/61.1; 454/27, 28, 168, 169, 170, 257, 258, 322, 333, 906

[56] References Cited

U.S. PATENT DOCUMENTS

| | | | |
|---|---|---|---|
| 3,125,286 | 3/1964 | Sanders | 454/906 X |
| 3,276,481 | 10/1966 | McNulty | 138/93 |
| 3,434,409 | 3/1969 | Fragnito | 454/322 |
| 3,593,645 | 7/1971 | Day et al. | 454/315 |
| 3,990,464 | 11/1976 | Jenkins | 251/61.1 X |
| 4,662,269 | 5/1987 | Tartaglino | 454/333 X |
| 4,762,115 | 8/1988 | Penner | 138/93 X |
| 4,852,851 | 8/1989 | Webster | 251/61.1 |

FOREIGN PATENT DOCUMENTS

| | | | |
|---|---|---|---|
| 1530787 | 12/1989 | U.S.S.R. | 454/168 |

*Primary Examiner*—Harold Joyce

*Attorney, Agent, or Firm*—Anthony Asquith & Co.

[57] ABSTRACT

An inflatable bag of flimsy plastic material is placed in the air duct of a house or other building. The bag is coupled to a fan and electric motor. The device is placed near the duct outlet register, where it can be easily inserted and retrieved. The motor is operated, to inflate/deflate the bag, by a thermostat in the room via radio connection between the thermostat and the motor. When the bag is deflated, the duct is open, and treated air from a central unit can then enter the room. The bag takes air from inside the duct, and static pressure inside the duct holds the bag inflated; when the bag is deflated, the air intake faces away from velocity of the flowing air, so the flowing air does not tend to inflate the bag. The fan motor is driven by a battery.

19 Claims, 1 Drawing Sheet

AIR DUCT CLOSURE SYSTEM

This invention relates to the control of air flow in ducts.

In a conventional central heating/cooling system in a building, air is led from a furnace or air-conditioning unit through ducts to outlet openings in the rooms of the building. The outlet openings are usually covered by grills or registers.

Conventionally, the basis of the operation of the system is that the furnace or air-conditioner is switched either full-on or full-off through a strategically-placed thermostat. As far as control of air-flow to the different outlet registers is concerned, usually the only control the occupant of the building has is to (manually) open or close the grill.

Often, a central ducting system will include pre-settable butterfly valves in at least some of the ducts, whereby air flow can be turned or balanced to the various rooms or zones of a building. However, often these valves are not pre-set properly, so that air flows more easily to some ducts and outlet openings than to others.

The invention is aimed at providing a duct-closure system whereby the air flow in a duct or through an outlet opening can be controlled locally. In the invention, the duct closure means is controlled and operated, and powered, by electricity.

In a domestic system, which has, say, one outlet opening per room, a benefit of the invention lies in enabling the outlet to be controlled very conveniently by the occupant of that room. The device of the invention may be controlled by a simple electrical switch.

Alternatively, a further thermostat may be installed in the room, which controls the device to open and close the outlet in accordance with the temperature in the room. The on/off operation of the central air-conditioner or furnace unit in that case is still under the control of the central thermostat.

Although it is possible, with the conventional manually closable outlet grills, for a person actually to operate the grill on an hour-by-hour basis to control the temperature in a room, in fact this is seldom done. The device of the invention provides an electrically-operated means for closing the duct or outlet.

The device may be thermostatically controlled, and thus operate entirely automatically. Even without the thermostatic control, it is worthwhile to install the device in a duct, simply because it makes the operation of closing the duct so much more convenient than hand-operating the grill.

In the conventional systems, it was possible, theoretically, that a person might manually operate the grill in such a way as to maintain the room at a comfortable temperature, and also make savings as to the amount of energy used by the central unit. In practice, however, in conventional systems, much heating and air-conditioning energy is wasted because the treated air is able to flow through some or all of the outlets when not required.

It has been estimated that if the outlet openings in all the rooms of a house were thermostatically controlled, and were set up also according to a time-of-day heating-/cooling program, up to 40 per cent of the house's fuel costs could be saved, and that this saving could be achieved without any perceptible loss of comfort.

In an institution like a hotel or hospital the savings can be even greater. The institution has a single central air-conditioning/heating unit, which is thermostatically controlled in the conventional manner. The invention provides a means for controlling the flow of air through each particular duct, the flow to each room being under the control of local thermostats.

For example, in a hotel, a central control panel, say at the hotel desk, can be used to set the thermostat in an unoccupied room to a "non-occupied" temperature; then, when a guest checks in, the clerk simply re-sets the thermostat to an "occupation" temperature. Fine tuning of the in-room thermostat can be under the control of the guest.

The savings in energy costs for the institution by such a system can be enormous, in that adequate comfort can be provided in each room, according to the particular requirements in that room, without wastage of energy.

The invention provides convenient, simple, inexpensive, electrically-operated closure of the duct or outlet opening, and as a result the invention permits the temperature of a room to be very tightly controlled. Consequent upon such tight, but convenient, control, the temperatures of the rooms of the hotel or other institution, or house, may be programmed, for example, on a time-of-day basis, and the room can be set not only to occupied and unoccupied status but also to "standby", "closed", "night", and so on. The programming may of course be under the control of a computer.

The duct closure device of the invention is passive in the sense that it does not heat or cool the air by itself. The device is operated in conjunction with a central heating/air-conditioning unit, which will normally have its own thermostat. For proper temperature control of the room, of course air flows from the outlet opening when the device of the invention opens the duct, but it will be understood that air flow may be intermittent, in accordance with the dictates of the thermostat on the central heating/air-conditioning unit.

In the case of a domestic residence, it is all too common for one room of the house to be inadequately heated (or cooled); this is especially so with a remote bedroom, for instance (or even for the whole upstairs floor). One reason for this is that the builder failed to install/adjust the ductwork properly to give equally adequate air flow and pressure to all the various outlet openings.

Of course, it is preferable to have a correctly adjusted and balanced ducting system installed in the house. But the ducting systems in many existing (and newly-built) houses are grossly unbalanced, so that there might be difference or 8 or even 10 deg C. between the bedrooms and the ground floor of a house. The unbalance is often most noticeable with air-conditioning rather than with heating.

However, even in a perfectly-installed system, the problem of unequal heating/cooling in different rooms involves a compromise that negates the possibility of a simple cure, in many cases. The rooms that are furthest away from the central heating/air-conditioning unit have the longest ducts and therefore the air-flows to those rooms suffer the most from friction losses etc in the ducts. Furthermore, the bedrooms tend towards more extreme temperatures because they are closer to the roof of the house.

For good balance, therefore, it might be considered that the ducts to the upstairs rooms should be considerably larger than the ducts to the ground floor rooms, because the upstairs ducts are longer, and because the upstairs rooms experience more extreme temperatures.

However, it would be uneconomical to supply heated or cooled air in large quantities to the bedrooms other than for these brief periods when the occupants are going to bed or getting up.

The upshot is that the ducts installed to the bedrooms are usually smaller, not larger, than the ducts installed to the ground floor rooms. This makes the comfort of the remote bedrooms especially vulnerable to the ductwork being installed or adjusted even slightly badly. It may be noted that the ductwork which enables extraction and circulation of air back to the central unit, is equally critical.

In a typical real case, as a practical matter, adequate air flow would only reach the remote bedroom if the householder were to close (nearly) all the other outlet openings in the house, i.e. to go round the house and close the outlets by hand. But it is almost unheard of for a householder actually to do this on any regular basis.

When, however, as arises in the invention, the ducts in the building are closable electrically, and are under automatic (thermostatic) control, the ducts to the other rooms now will inevitably, from time to time, be closed long enough for adequate periods to ensure that every room in the house receives a full supply of treated air, even if the ductwork is quite badly out of balance.

In the invention, the system may be controlled either centrally or locally, or in combination. For example, the central air-conditioning/heating unit will generally have its own thermostat, placed in some strategic location, and use of this central thermostat, to control the operation of the central unit, may be continued. Respective thermostats may be provided one in each room to control the opening and closing of the duct to that room. Alternatively, it can be arranged that the individual thermostats sensors in the rooms are coupled to the central heating/air-conditioning unit, whereby the central unit remains "on" so long as any one of the individual thermostats signals a need therefor.

Thus, individual room thermostats are generally used to control the operation of the duct closure devices; but in addition it may be arranged, if desired, that the individual room thermostats also control the central air-conditioning/heating unit. In both cases, the supply of treated air, both to the main areas and to the remote rooms, can be maintained at a comfortable level; yet the amount of energy required to maintain that comfort in every room is reduced to a minimum.

It is generally preferred that the duct in which the closure device of the invention is placed is the duct through which treated air is supplied to a room. However, the device may, if desired, be placed in the extraction duct which conveys spent air back to the central unit.

The duct closure device of the invention comprises an inflatable bag, preferably of a plastic film material. The bag is inflated with air provided by an electrical motor means, preferably by an electrically driven fan. The bag and motor means are placed inside the duct, preferably by being inserted into the duct, by hand, through the outlet opening.

The device is simple and inexpensive to manufacture. The device may be installed with a minimum of expense, and with a minimum requirement for installation skill. In a building, usually the closure devices will be installed one per room, so that quite a number of the devices will be needed for the building; therefore, low cost and ease of installation are important factors.

The device may be installed in a new building as part of the design of the ducting system, or the device may be installed in the ducts of an existing building. The flexible inflatable bag means that a single size of the device serves for operation with a range of duct sizes.

By way of further explanation of the invention, an exemplary embodiment of the invention will now be described with reference to the accompanying drawings, in which:

FIG. 1 is a cross-section through an air duct and an outlet register thereof, in which is located a duct closure device which incorporates the invention.

DETAILED DESCRIPTION OF PREFERRED EMBODIMENT

Figure 1:
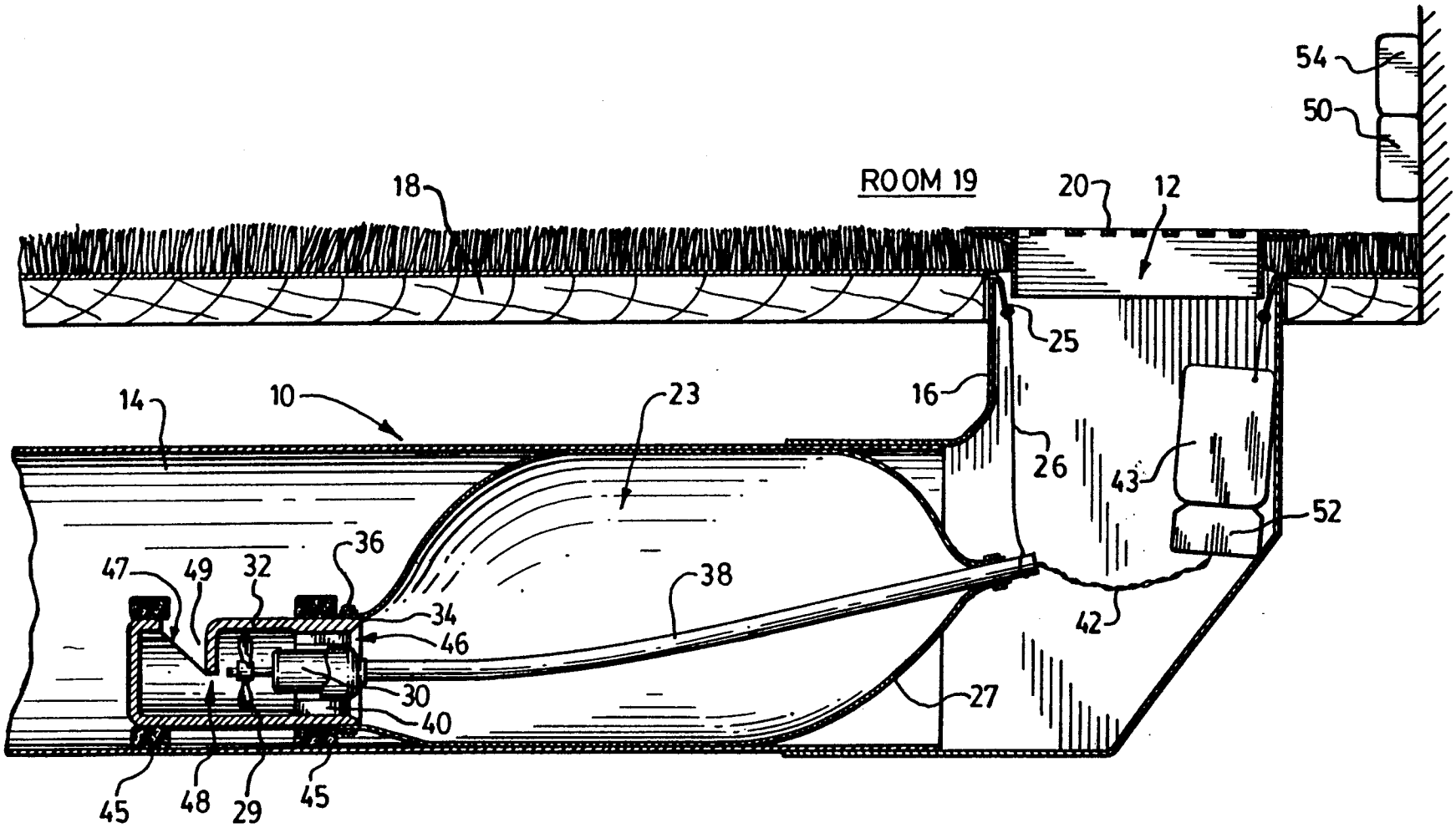

The apparatus shown in the accompanying drawing and described below is an example which embodies the invention. It should be noted that the scope of the invention is defined by the accompanying claims, and not necessarily by specific features of exemplary embodiments.

FIG. 1 shows a portion of an air duct 10 of the kind which is conventionally installed in a house or other building. The duct is used to convey air from a central air-conditioning/heating unit. The duct 10 passes through the walls and under the floors of the building in the usual way, and terminates at an outlet opening 12.

The duct comprises, as to its main length, a tubular portion 14 of thin sheet metal. This portion opens into a conventional sheet metal transition piece 16. The transition piece 16 is secured, by nails, to the wood of the floor 18 of a room 19. The outlet opening is provided with a register or grill 20.

An air duct closure device 23 is located in the duct 10. To install the device, the grill 20 is lifted out, and the device is passed into the duct through the outlet opening. This can easily be done by hand, by a person. The device 23 includes a clip or hook 25, and a suspension line 26. The person places the hook over an edge of the piece 16, whereby the hook slips into the gap between the piece and the floor.

The hook 25 prevents the device from moving too far into the duct 10: this is not too important a function when the duct is horizontal, but can be vital when the duct is sloping or vertical.

The duct closure device 23 comprises a bag 27 of thin plastic film or sheet; a fan 29; a fan motor 30; and a fan housing 32. The plastic material of the bag 27 in fact is tubular, and the material is formed into an enclosed bag by virtue of the ends of the tube being gathered.

At one end of the bag 27, the tube of plastic material is gathered over a cylindrical spigot 34 formed on the fan housing 32. The gathered end of the tube is secured to the spigot by means of a tie 36.

The fan housing 32 is provided with a built-in semi-flexible extension, in the form a plastic pipe 38. At the other end of the bag 27, the tube of plastic material is gathered about the plastic pipe 38.

The fan motor 30 is located in position in the housing 32 by means of a spider 40, and the fan 29 is mounted on the spindle of the fan motor 30. The electrical leads 42 of the motor 30 are housed in the plastic pipe 38. The pipe 38 is fixed to, and sealed to, the motor and the housing 32 in such a manner that the hollow interior of the pipe 38 does not communicate with the interior of the bag 27.

The plastic pipe 38 serves not only as a conduit for the leads 42, but serves also to maintain the bag 27 in its correct position, which is needed especially when the bag is deflated, or is being inserted into position in the duct. If the bag were free during insertion, the bag might become twisted or folded.

The electrical leads 42 extend to a battery pack 43. The battery pack preferably is supported in position in the duct on its own hook and suspension line. An LED may be provided for indicating the condition of the battery, the LED being visible upon removal of the grill 20. The battery can be renewed without taking the device out of the duct.

The shape of the housing 32 is basically cylindrical, and somewhat elongate, whereby the housing naturally resides on the bottom of the duct wall, with its cylindrical axis horizontal, as shown in FIG. 1. Strips 45 of sponge or foam plastic are secured around the housing 32, and the sponge material serves as a cushion or muffler between the housing and the duct wall.

A duct such as the duct 10 is an all-too-efficient amplifier and transmitter of sound, and it is important in a domestic installation that the noise made by the fan motor, which is likely to be a high-pitched whining noise, should be muffled as much as possible. The sponge strips 45 are made soft enough to isolate the noise and vibrations of the fan motor. Even so, the fan and motor should be selected and designed to operate at low enough speeds that the sponge cushions can cope with damping the vibrations and noise produced by the motor. The cushions extend all round the housing, so that the person installing the device does not have to orientate the device in any particular way.

The fan housing 32 defines an air passage 43 through which the interior of the bag 27 is in air communication with the interior of the duct 10. The air passage 43 in the housing 32 has a bag-mouth 46 which opens into the bag 27 and a duct-mouth 47 which opens into the duct 10.

The air flow induced by the central air-conditioning-/heating unit flows along the duct 10 in the direction from left to right in FIG. 1. The duct-mouth 47 is so disposed in the housing as not to face upstream with respect to this flow of air. The duct-mouth 47 is so positioned that the velocity or momentum of the air flowing in the duct does not carry the flowing air into the air passage 43. A deflector 48 assists in preventing air from flowing under its own momentum directly into the air passage 43.

When the fan motor 30 is switched on, the fan 29 rotates and draws air from the duct 10 through the air passage 43 and into the bag 27. When the fan 29 is running, therefore, the bag 27 inflates. The air used to inflate the bag 27 is drawn from inside the duct 10.

If the duct-mouth 47 were to face upstream, it might happen that the momentum of the air flowing in the duct 10 would carry the air into the bag 27 and thus inflate the bag. Because of the location and orientation as described of the duct-mouth 47, the bag 27 does not tend to inflate itself due solely to the movement of air in the duct 10. The bag 27 only inflates when the fan 29 is running.

The bag 27 inflates until it completely fills the duct 10, at which point the air flow in the duct, and from the outlet opening 12, ceases. However, since the central heating/air-conditioning unit is still running, the static air pressure remaining inside the duct 10 is somewhat higher than the air pressure in the room 19.

The static air pressure is unaffected by the orientation of the duct-mouth 47, and in fact the air pressure inside the bag 27 tends to equalise to the pressure inside the duct 10, once the dynamic flow of air has ceased. Thus, when the bag is fully inflated, and the velocity of the air flow in the duct drops to zero, the increased pressure inside the duct then tends to maintain the bag in the inflated condition.

Thus, under the right circumstances, it is possible for the fan 29 to be switched off, and yet for the bag 27 then to remain in the inflated condition, and thus to continue to maintain the duct in the closed condition, even though the fan is no longer running.

When the duct 10 is open and air is flowing in the duct, there is little tendency for the flowing air to enter the bag 27, because the duct-mouth 47 does not face into the air flow. (In fact, it can happen that the dynamics of the flowing air can create a pressure drop which tends to draw air out of the duct-mouth, and therefore to deflate the bag still more.) When the air flow stops, by contrast, the now static pressure inside the duct 10 extends equally into the bag, and keeps the bag inflated, the static pressure being unaffected by the orientation of the duct-mouth 47.

In the normal condition, with the duct 10 open, the fan is off, and the bag 27 remains deflated. To inflate the bag, the fan 29 is switched on, but the fan need only be left switched on for a few seconds, while the bag is being filled with air. The fan is then switched off, but, as described, the bag remains inflated. To deflate the bag 27, the fan motor 30 is switched on in reverse, but again, the fan need only be kept on for a few seconds, while the fan draws the air out of the bag, the bag collapses, and the air flow in the duct is re-established.

Mainly because of the orientation of the duct-mouth 47, when the duct 10 is open, the flowing air in the duct tends to keep the bag deflated, and the duct open; when the duct is closed, the static air pressure in the duct tends to keep the bag inflated, and the duct closed. The major benefit which arises from this is that the fan need be operated only in short bursts, and need not be kept running all the time. Therefore, the fan motor 30 may be battery-powered.

If the fan 29 is operated in bursts of, say, five seconds, three or four times per hour, there is sufficient power in the kind of battery 43 that would be considered for the device 23 as described to last for two, three, or even more years.

If the fan had to operate continuously, either in forward or reverse, or both, it would hardly be practical to power it by means of a battery, and the device would have to be connected to mains electricity.

The plastic film from which the bag is made preferably should not be such that the bag has an inherent resilience. When the air flow in the duct stops, due to the switching off of the central air-conditioning/heating unit, the pressure inside the bag disappears, yet it is desired that the bag will remain in position against the walls of the duct. If the bag were to be stretchy, like a balloon, when the air flow stopped the bag would shrink away from the walls of the duct. Then, when the air flow resumed, the duct would be open.

When the bag is made of very flimsy material, as is preferred, then, when the central air flow stops, the bag remains in contact with the walls of the duct, to a sufficient extent that, when the central air flow restarts, the bag is in position close enough to the duct wall that the bag readily seals itself to the duct wall sufficiently to allow pressure to build up once more inside the bag, and once more hold the bag in the inflated condition.

Flimsy plastic film material can be expected to remain in close contact with the duct walls at least for the few minutes until the central air flow resumes. The designer should bear in mind that the greater the dimensional length of the bag, the greater the time that can be expected before the unpressurised bag starts to lose contact with the walls of the duct. The bag should be such that the length of the bag, when inflated into the duct, is at least as long as a diameter of the duct.

It is an advantage that the device as described is not limited to a specific size of duct, but sufficient margin of overall length should be provided to ensure a good length of engagement of the bag to the duct even if the duct is of a large diameter.

Just in case the bag might start to lose contact with the duct walls during periods when the central air flow is off, it will usually be preferable to activate the fan for a few seconds, to make sure the bag remains topped-up in the inflated condition, say four or five times an hour.

When the device 23 is operated by a battery 43, there need be no wire connections to the device. However, the device is under thermostatic control, and the thermostat sensor 50 of course is in the room 19, not in the duct 10. It can be arranged that the on-off signals from a thermostat can be communicated to the device via radio. A radio system which transmits over a range of a few feet is all that is needed, and such systems are inexpensive, in the context of the device as described. The battery power required to operate the receiver of such transmissions, the receiver 52 being located in the duct, is negligible. The transmitter 54, being in the room thermostat, may be mains-powered, although again power consumption is almost negligible.

Control features such as pulse timing can be pre-programmed into a suitable circuit located in the receiver, which is built into the device. Alternatively, especially if a number of radio channels are available, timing, and other features such as set-back temperatures, circuits can be placed in the room, and can be under the control of the occupant.

The duct closure device may, if desired, be so arranged that the fan runs continuously. In that case, when the duct is required to be closed, the fan continuously blows air into the bag, and maintains the bag in the inflated condition; when the duct is required to be open, the fan spins continuously in the reverse sense of rotation, and extracts air from the bag.

As mentioned, battery power is inappropriate if the fan has to run continuously. Also, the quality of the fan motor is much more demanding if the usage rating is continuous. The cushioning and noise elimination from the fan housing becomes more important, since a constant whining noise coming out of an air outlet, say in a bedroom constantly through the night, could be quite irksome.

Apart from the ease of installation due to the elimination of wiring, battery power will be selected if possible also for the above reasons.

Sometimes, batteries cannot be used. As shown in FIG. 1, the bag 27 is downstream of the fan/housing-/motor unit, and downstream of the mouth 47 from which the air is taken which will inflate the bag. It may be noted that sometimes the bag may be placed upstream of the air-intake mouth, instead. In that case, the air pressure in the bag would have to be higher, since the inflation pressure in the bag is now being opposed, not assisted, by the static pressure in the duct. With the bag upstream, the fan would have to be "on" continuously, in order to keep the bag inflated. Thus, placing the bag upstream imposes more demands on the motor, and on the electrical supply.

Sometimes unpredictable pressures can arise in ducts, especially when the ductwork in a large building is intricate, and perhaps not balanced properly. In these cases, if the fan were operated, as described, in pulses of only a few seconds, it might turn out that the duct would be open for long periods when it should be closed, and vice versa. (It may be noted that it would be inconvenient to provide a display to the room occupant as to the inflated or deflated condition of the bag.)

As these examples show, there are cases where the designer will find it appropriate to specify that the fan motor be set to spin continuously, in which case batteries are hardly practical.

With continuous rotation, the sense of rotation of the motor is what determines whether the bag is inflated or deflated. The fan motor may be driven by DC electricity, in which case the direction of the motor may be reversed by changing the polarity of two wires; or the motor may be supplied via three wires, to enable reversibility.

When the device is powered through wires running outside the device, there is usually then no disadvantage in running control and signal wires also outside the device, so that radio connections would not be required. The power and signal wires may be connected to suitable points in the room. (The power actually present in the wires inside the duct of course would be transformed to low voltage, for safety.) Alternatively, the power and signal wires may be fed along the duct itself, back to a central point, and to a control panel located there. The control panel may operate with a combination of manual settings and pre-programmed computer settings, as described above.

As mentioned, the bag is preferably of flimsy plastic film. This material is preferred for another reason, which is that the flimsy material has a good resistance to being punctured.

Ductwork in buildings often is put together with screws, and the screws can constitute long sharp points which protrude into the duct. In particular, for example, such screws are often used to fasten the duct to the transition piece. There is a danger, therefore, that the bag can become snagged on the screw points.

Flimsy plastic film material can conform itself around such points, where a stiffer material might be stressed at the point of the screw to the extent of being punctured. Thus, the stiffer material, though of course stronger, can be less resistant to puncturing than the flimsy film.

Flimsy material can be expected not to become punctured by a screw point, unless the material were to be actually moved over the screw point. This could happen, for example when the device is being inserted into, or removed from, the duct. Of course, such insertion or removal should be carried out with the bag fully deflated, and with care to avoid snagging the material.

Also, the conformability inherent in the flimsy film helps to ensure that the duct will be adequately sealed: ducts are not perfectly smooth, but include bumps and junctions of irregular shape.

In fact, the bag need not make a perfect seal to the duct: the need is for the bag, when inflated, to substantially stop the flow of air, and also to allow a difference in air pressure to exist between the duct and the room. The requirement is not that there be no leakage of air whatsoever.

It is also sometimes permissible for the bag to be not quite airtight. Especially when the bag is made of very flimsy material, the bag moulds itself to the contours of the duct walls very intimately, and this happens even though the air pushed into the bag by the fan might be leaking out. Thus, if the bag should become punctured, if the puncture is not too serious the bag should still be able to perform satisfactorily to close the duct.

In some installations, it is possible for the designer to dispense with the reversing of the fan, to drive air out of the bag. This is especially the case in straightforward non-marginal installations, where the flow of air is large, and there is a large difference in static pressure between a closed duct and the room. In these cases, the fan may be powered constantly when the bag is required to be inflated, but the fan is simply switched off when the bag is to be deflated.

Designing the bag to deflate on its own leads the designer to provide a bag in the form of a resilient balloon, where the resilient stretch of the material of the balloon provides the energy necessary to drive the air out of the balloon. However, as mentioned, more flimsy material, with little resilience, is preferred for the bag.

Allowing the bag to deflate on its own is also best suited to a case where the bag is placed on the upstream side of the fan. In this case, the air pressure within the duct provides assistance to the resilience of the bag, in driving air out of the bag.

In the preferred version, as described, on the other hand, the bag is capable of conforming itself to the walls of the duct when inflated, and of remaining thus for at least several minutes when the fan is switched off. This capability arises from a combination of the characteristics of the material of the bag, and the magnitudes of the pressures, pressure differentials, and velocities of air likely to be found in air-conditioning/heating ductwork in a building.

It may be noted that the duct-closure device as described is eminently suitable for on-off closure of the duct, where the duct is either fully open or fully closed. Where the requirement is for the duct to be partially closed, on the other hand, the device may still be used with advantage.

With partial closure, the problem arises of holding the bag steady at an intermediate state of inflation. In the device, the inflation of the bag is controlled electrically; in the case where the bag is to be set to a particular level of inflation, the electrically driven fan can be set to cycle rapidly between forward and reverse, whereby the state of inflation is constantly being corrected to some set level. The timing and ratios of the forward/reverse cycling may be controlled by a feedback circuit, which senses for example the back-pressure or flow velocity of the air in the duct.

We claim:

1. A duct closure system, which is suitable for operative use in a building having at least one duct for conveying centrally heated or cooled air to a room thereof, wherein:

the system includes a duct closure device;

the device includes an inflatable bag of flexible material;

the device includes an electrically-operable inflation/deflation means for moving air into and out of the bag;

the system includes an electrical switching means, by means of which the inflation/deflation means may be operated to inflate and deflate the bag;

the arrangement of the system is such that when the switch is operated in a first sense the inflation/deflation means is effective to cause air to enter the bag to inflate the bag, and is such that when the switch is operated in a second sense the inflation/deflation means is effective to cause air to leave the bag, to deflate the bag;

the dimensions and disposition of the bag are such that the bag, when operatively installed in the duct and inflated, substantially completely fills the cross-section of the duct and is thereby effective to close the duct to the passage or flow of air along the duct, and are such that the bag, when deflated, offers substantially negligible interference to the flow of air along the duct;

the system includes a support means which is effective to support and locate the device inside the duct, and which is effective, when the bag is deflated, to maintain the bag in position and in readiness for inflation;

the system is suitable for operative cooperation with a duct of the kind that terminates at an air outlet opening for admitting air from the duct into a room, and the device is suitable for positioning in the duct, close to the air outlet opening;

the device is insertable into and removable out of the duct through the outlet opening;

the bag and the inflation/deflation means are assembled together into a self-contained unitary assembly, which is insertable and removable, as a whole, through the outlet opening.

2. System of claim 1, wherein the inflation/deflation means comprises a fan, and a rotary electric fan motor, which is operatively coupled to the fan; and the device includes a fan housing, and the fan motor is mounted, with the fan, in the fan housing.

3. System of claim 1, wherein the bag comprises a body of flimsy plastic film.

4. System of claim 2, wherein the bag comprises a body of flimsy plastic film, and the plastic film is sealed to the fan housing.

5. System of claim 2, wherein the housing has a spigot, and the plastic film is gathered around, and is physically and sealingly clamped to, the spigot.

6. System of claim 1, wherein the inflation/deflation means includes a passage for conveying air into and out of the bag, the passage having a bag-mouth inside the bag and an intake and exhaust mouth outside the bag; and the arrangement of the system is such that the said intake and exhaust mouth of the passage opens into the duct.

7. System of claim 6, wherein the arrangement of the support means is such that the intake and exhaust mouth, when the bag is operatively installed in the duct, and when the duct is closed by the bag being inflated, is open to the pressure of air within the said closed duct, and is isolated, by the inflated bag, from the pressure of air in the room.

8. System of claim 7, wherein the arrangement of the support means is such that the intake and exhaust mouth faces downstream, to the extent that, when the bag is deflated, air flowing with a velocity along the duct substantially cannot directly enter the intake and exhaust mouth without changing direction.

9. System of claim 2, wherein the housing is in the form of an elongate cylinder, and the arrangement of the support means is such that the housing rests against a wall of the duct, with the cylindrical axis of the housing lying parallel to the wall of the duct.

10. System of claim 9, wherein the housing includes a muffler, which is effective to isolate the duct from noises and vibrations produced by the fan and motor; and the muffler comprises a body of soft sponge or foam disposed right around the circumference of the housing.

11. System of claim 2, wherein the housing includes a muffler, which is effective to isolate the duct from noises and vibrations produced by the fan and motor.

12. System of claim 2, wherein the electrical switching means is effective to switch the fan motor for rotation in both rotational senses.

13. System of claim 1, wherein the support means includes a hook or clip which is adapted to engage the structure of the outlet opening.

14. System of claim 1, which includes a battery which is effective to supply electrical power to the inflation/-deflation means.

15. System of claim 14, which includes a means for physically supporting the battery inside the duct.

16. System of claim 14, which is so arranged that the switching means operates the inflation/deflation means only for brief periods of time upon inflating/deflating the bag, and is so arranged that the battery remains isolated from the inflation/deflation means apart from said brief periods.

17. System of claim 16, wherein the system includes a controller for controlling the inflation and deflation of the bag; the controller is located outside the duct; and the controller and the device include a transmission/-reception apparatus by means of which control signals are sent from controller to device by wireless transmission.

18. System of claim 1, wherein the support means is effective to position and support the device in the duct in such a way that, and to position the device sufficiently close to the outlet opening that, a person in the room may, while leaving the duct intact, reach inside the duct by inserting a hand through the outlet opening, and may grasp the device, and may withdraw the device from the duct, in the hand, through the opening.

19. System of claim 1, wherein the material of the bag, though flexible, is not, in substance, resiliently stretchable at the air pressures encountered in the duct.

* * * * *